United States Patent [19]

Koppers et al.

[11] 4,255,071

[45] Mar. 10, 1981

[54] SUPPORTING OF EXCAVATION ROOFS

[75] Inventors: Manfred Koppers, Duisburg; Klaus Spies, Dortmund; Karlheinz Bohnes, Bochum, all of Fed. Rep. of Germany

[73] Assignee: Bochumer Eisenhütte Heintzmann GmbH & Co., Bochum, Fed. Rep. of Germany

[21] Appl. No.: 70,307

[22] Filed: Aug. 27, 1979

[51] Int. Cl.[3] ..... E21D 23/04

[52] U.S. Cl. ..... 405/290; 52/724; 52/741; 248/356; 264/33; 425/63; 405/230

[58] Field of Search ..... 405/288, 290, 230, 239; 52/741, 632, 724, 725; 264/33, 34; 425/63; 248/356

[56] References Cited

U.S. PATENT DOCUMENTS

| | | | |
|---|---|---|---|
| 1,229,364 | 6/1917 | White | 405/230 |
| 1,615,815 | 1/1927 | Birdsey | 52/725 X |
| 2,451,777 | 10/1948 | Salas | 405/230 X |
| 3,108,403 | 10/1963 | Jackson | 405/229 X |
| 3,562,056 | 2/1971 | Olson | 264/33 X |
| 3,564,804 | 2/1971 | Archer et al. | 52/741 |
| 3,594,973 | 2/1971 | Archer et al. | 52/741 |
| 3,728,864 | 4/1973 | Wiswell | 405/216 |
| 3,798,867 | 3/1974 | Starling | 52/724 |
| 4,092,832 | 6/1978 | Mattson | 405/229 |
| 4,185,940 | 1/1980 | Spies | 405/239 X |

FOREIGN PATENT DOCUMENTS

| | | | |
|---|---|---|---|
| 580133 | 7/1958 | Italy | 248/356 |
| 212189 | 4/1967 | Sweden | 405/230 |
| 325093 | 2/1930 | United Kingdom | 405/230 |
| 635261 | 11/1978 | U.S.S.R. | 405/290 |

*Primary Examiner*—Dennis L. Taylor
*Attorney, Agent, or Firm*—Michael J. Striker

[57] ABSTRACT

Roofs of underground excavations are supported by forming sheet-material elements into tubes whose diameter can be varied by changing the overlap between the longitudinal edges of the rolled-up sheet material, standing the tubes upright to bear against the roof and the floor of the excavation, and filling them with hardenable material in flowable condition which, after hardening, will form a roof-supporting column.

17 Claims, 14 Drawing Figures

SUPPORTING OF EXCAVATION ROOFS

BACKGROUND OF THE INVENTION

1. Field of the Invention

The present invention is directed to a method of supporting a roof, particularly a roof of an underground excavation such as a mine, and to a system for carrying out the method, i.e. to apparatus for this purpose.

2. The Prior Art

In underground excavations, for example in mining galleries, tunnels and the like, it is usually necessary to support the roof of the excavation against cave-in under the pressure of the overburden. Various approaches for effecting such support are known from the prior art. For example, in coal mining it is known to use the so-called "room and pillar system" in which roof bolting is used, i.e. steel rods or bars which penetrate the rock layers and hold them together to prevent collapse. It is also known to provide various types of supporting structures of wood and/or steel in which rigid or slightly yieldable supporting elements are used to support the roof from below against collapse.

The problem with this latter type of approach, to which the present invention is also directed, is that the prior-art proposals are all relatively complicated and expensive and are difficult to erect and to move. The elements involved are relatively expensive and of considerable weight so that they are difficult to handle. There is also a decided lack of economy, both in the materials involved and in the installation work required.

SUMMARY OF THE INVENTION

It is a general object of the present invention to overcome the disadvantages of the prior art.

A more particular object of the invention is to provide an improved method of supporting an overburden, particularly a roof of an underground excavation such as a mine, which is not possessed of the prior-art disadvantages.

A concomitant object of the invention is to provide such an improved method which allows the handling and installation of the support elements in a simpler and quicker manner than heretofore possible.

Another object of the invention is to provide such a method which facilitates the erection of roof supports and reduces the costs involved therein.

A further object of the invention is to provide an improved system (e.g. arrangement) for supporting a roof, particularly a roof of an underground excavation such as a mine.

The improved system is to be simpler and less expensive to construct than those of the prior art.

An additional object of the invention is to provide such an improved system which utilizes support elements that can be readily moved and installed because they are light in weight.

A concomitant object of the invention is to provide such a system wherein the support elements are inexpensive.

Still another object is to provide a system the prop casings of which can be transported and stored in substantial quantities at a time, but require extremely little space.

Yet a further object is to provide such a system in which the diameter of the prop casings (and hence the final load-bearing capacity of the ultimately obtained column) can be varied in an extremely simple and efficient manner.

Pursuant to the above objects, and still others which will become apparent from a reading of the specification, one feature of the invention resides in a method of supporting an overburden, particularly a roof of an underground excavation such as a mine. Briefly stated, such a method may comprise the steps of providing a hollow tubular prop casing having at least one section of self-supporting sheet material and which is circumferentially incomplete and has a longitudinally extending slit, overlapping marginal portions of the sheet material bounding the slit, to an extent requisite for obtaining a desired diameter of the section, arresting the overlapped portions in their overlapped condition, erecting the prop casing so that it bears upon the roof to be supported, and filling the prop casing with a hardenable substance in flowable condition so that the substance, upon hardening thereof, forms a solid column which is by itself able to support the roof.

The system or arrangement according to the invention may, briefly stated, comprise a hollow tubular prop casing having at least one section of self-supporting sheet material and which is circumferentially incomplete and has a longitudinally extending slit bounded by marginal portions which can be overlapped to a desired degree to give the section a selectable diameter, means for arresting the marginal portions in a desired overlapped position, and means for filling the prop casing, subsequent to erection of the same so that it bears upon the roof to be supported, with a hardenable substance in flowable condition so that the substance, upon hardening thereof, forms a solid column which is by itself able to support the roof.

It is important to understand that the inventive prop casing has no supporting function per se at all, acting only as a receptacle for the hardenable substance. The supporting function is carried out by the hardenable substance when the same has hardened and forms a solid column within the prop casing. For this reason the prop casing can be made of relatively lightweight and inexpensive material, for instance sheet metal, synthetic plastic material such as polyvinylchloride or polyethylene, or even of a heavy grade of cardboard the inner surface of which is coated (e.g. with wax or with foil of such synthetic plastic material as polyvinylchloride or polyethylene) to prevent the cardboard from disintegrating under the influence of the filler substance while the same is still in flowable condition.

The filler substance itself may be a concrete slurry, i.e. a mixture of water and a quick-binding cement, preferably in form of cement powder. Aggregate may be added (it may already be accommodated in the prop casing before the slurry is admitted into the same) to further increase the strength of the column being formed. In lieu of, or in addition to the aggregate the prop casing may, after it is erected at the place where support is required, already contain at least some of the cement powder which is ultimately required to make the slurry. Other materials are also suitable for the hardenable substance, for example gypsum which again may be reinforced with aggregate, or a two-component adhesive system of synthetic plastic material which, when the two components are admixed with one another, will harden and form the requisite solid column. Here, again, aggregate may be employed in addition, to become embedded in the two-component system so as to further reinforce the same. The aggregate can be in form of gravel or the like as is known from the construction industry. If gypsum is used, some or all of the gypsum powder required to form the solid column may already be contained in the erected hollow prop casing before water is admitted into the same, and if a two-component adhesive system is used one of the two components may already be wholly or in part accommodated in the erected hollow prop casing before the other component is admitted into the same. The aggregate may be admitted from outside during admission of the other component, or of the water, but preferably will already be present in the interior of the prop casing at this time.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 4:
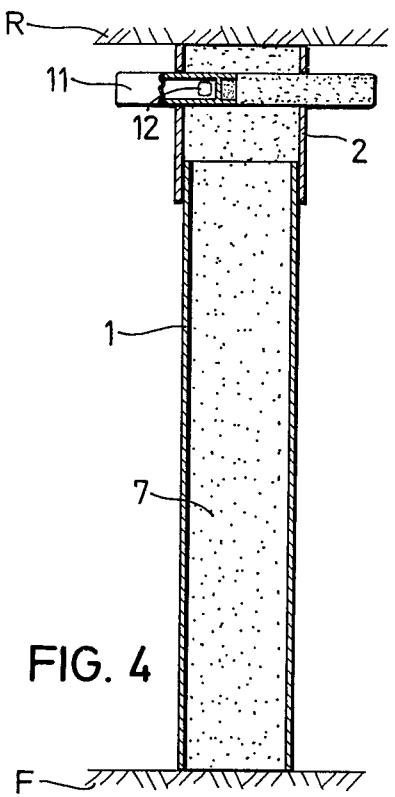
FIG. 4 is a vertical section showing still another embodiment.

In all Figures herein the overburden to be supported, e.g. the roof of a mining excavation, is designated with reference character R, and the floor with character F.

Figure 2:
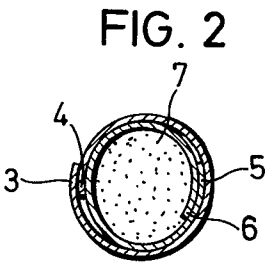
FIG. 2 is a section on line II—II of FIG. 1.
Figure 1:
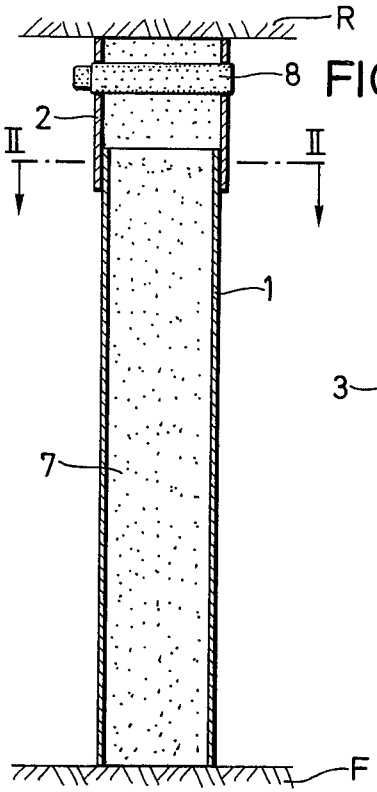
FIG. 1 is a somewhat diagrammatic vertical section, illustrating one embodiment of the invention.

With this in mind, and turning now to FIGS. 1–2, it will be seen that in the embodiment there illustrated the prop casing is composed of two tubular sections 1 and 2 which can be telescoped together or apart to change the length of the casing, as required. However, it is to be understood that a single casing may be used where telescopic adjustment is not required.

Each of the sections 1 and 2 is composed of one of the earlier-mentioned self-supporting sheet materials, i.e. of a material which is capable of retaining a tubular shape once given to it, and to confine the hardenable material for which it is to act as a casting form. The material of each of the sections is provided with a longitudinally through-going slit, as visible in FIG. 2. The slit of section 2 is bounded by marginal portions 3, 4 and the slit of section 1 by marginal portions 5, 6. These portions can be overlapped to the desired degree to thereby increase or decrease the diameter of the respective tubular section, for example in dependence upon the load to be supported by the same. How the portions are arrested in overlapped condition will later be described with reference to FIGS. 10–13.

After the portions have been overlapped and arrested in their overlapped condition, the casing is erected and the sections 1, 2 telescoped apart until they bear upon the roof R and floor F. In this position they may then be arrested against relative movement in axial direction of the casing; for example, in the manner disclosed in allowed U.S. application Ser. No. 860,096 the disclosure of which is incorporated herein in its entirety. Thereafter, the casing is filled with the hardenable material, e.g. again in the manner disclosed in the aforementioned U.S. application, and the material is allowed to harden.

When the hardening is completed the material forms within the sections 1, 2 a rigid support column 7 which by itself constitutes the support for the roof R. It will be appreciated, therefore, that the casing composed of the sections 1, 2 need only act to contain the material until it hardens to form column 7; i.e. it acts as a casting form having the particular virtues of light weight, adjustability, economy of material and economy of storage, transportation and installation.

During admission and hardening of the material which will ultimately form the column 7, use may be made of a device 8 which will be described in more detail later, in connection with FIGS. 4 and 5.

Naturally, more than two sections 1, 2 may be used together, so that the overall length (i.e. height) of the casing can be selected at will in accordance with the particular requirements of a given application.

Figure 3:
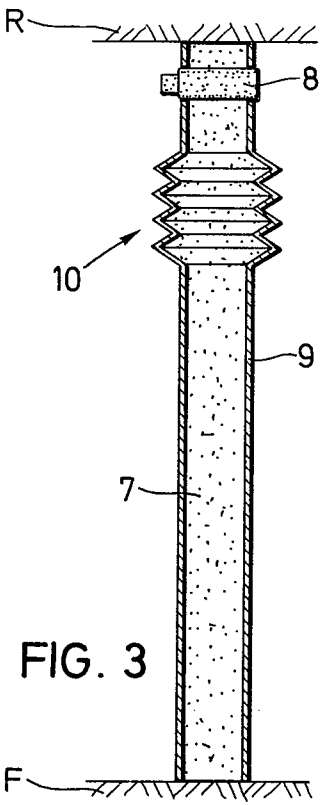
FIG. 3 is a view similar to FIG. 1, but of a different embodiment of the invention.

If, as mentioned before, a single-section casing is used, then the casing 9 may—as shown in FIG. 3—be provided with a portion shaped as a bellows 10. This bellows portion 10 is axially compressible to some extent so that, after the casing 9 is put in place between roof R and floor F and the compressing force is terminated, the inherent expansion of the bellows portion 10 causes the upper and lower ends of the casing 10 to be urged against the roof and the floor with sufficient force to hold the casing in place and to prevent escape of the flowable material while it undergoes hardening. Of course, use of this measure is also possible in a bi-partite or multi-partite casing (e.g. the one in FIG. 1), if desired.

Figure 5:
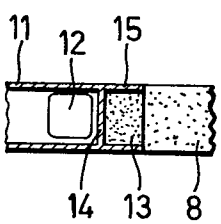
FIG. 5 is a partly sectioned enlarged view showing a detail of the embodiment in FIG. 4.

The embodiment of FIGS. 4–5 makes use of the same sections as FIGS. 1–2 and, therefore, the same reference numerals have been used for these sections as well as for the column 7.

The device 8 is shown in detail in FIGS. 4 and 5. Its purpose is to avoid loss of pressure or of volume in the hardenable substance after the same has been filled under pressure into the prop casing. If such a loss were to occur, the hardenable substance would recede downwardly out of contact with the roof R; this would prevent the firm engagement required to support the roof.

Device 8 cooperates with the filling tube 11 which is provided in its wall with at least one opening 12 that communicates with the interior of the casing when the tube 11 and device 8 are installed in registering apertures of the casing wall. Flowable material admitted into the tube 11 enters the casing through the opening 12. Device 8 is in effect a plug which may be a tubular container filled with concrete or any other suitable material (or it may simply be a concrete casting) and has at its leading (inner) end a reduced-diameter portion.

Inwardly of the opening 12 the filling tube has an end-wall 14 and inwardly of the same a tubular extension 15. After the tube 11 is installed in the casing from one side, the plug 8 is inserted into the casing from the other side until its portion 13 enters the tubular extension 15. The casing is now filled with the hardenable substance via tube 11 and opening 12. When filling is completed, but while the not-illustrated filling device still feeds material under pressure to the tube 11 (i.e. still maintains pressure upon the contents of the casing) the plug 8 is driven into the casing, as indicated by the arrow in FIG. 4, until the portion 13 enters the aperture through which tube 11 (which in the process is being expelled) previously extended into the casing. The portion 13 now closes this aperture and the device 8 thus prevents the loss of pressure or volume.

Figure 6:
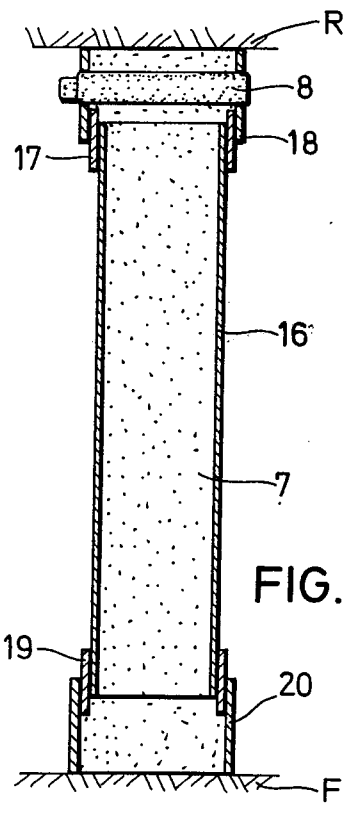
FIG. 6 is a vertical sectional view illustrating an additional embodiment.

The embodiment in FIG. 6 is similar to the one in FIG. 4, except that here the casing is made up of a center section 16 onto the top of which two extension sections 17, 18 are telescoped, whereas two further extension sections 19, 20 are telescoped onto the bottom end of the section 16. The device 8 is used again, as before.

The use of the multiple extension sections permits length adjustment of the casing to the requisite extent. That could, however, also be achieved by using two sections 16 of e.g. identical length, whereas it will be noted that the sections 17–20 in FIG. 6 are rather short. The reason for this is that these short sections 17–20 are used only secondarily to extend the length of the overall casing. Their primary purpose is to provide a larger interface between the column 7 and the roof R, respectively the floor F. This, as will be evident from the drawing, is achieved by the fact that several (here two at each end) successively larger-dimensioned sections are used, so that the inner diameter of the final section 18 respectively 20 is substantially larger than the corresponding diameter of the section 16. Naturally, the diameter of the surface of that portion of column 7 which is located in the respective section 18 or 20 and which engages the roof or floor, will similarly be larger. This embodiment is therefore especially suitable for use in circumstances where the roof and/or floor is not very stable.

Figure 7:
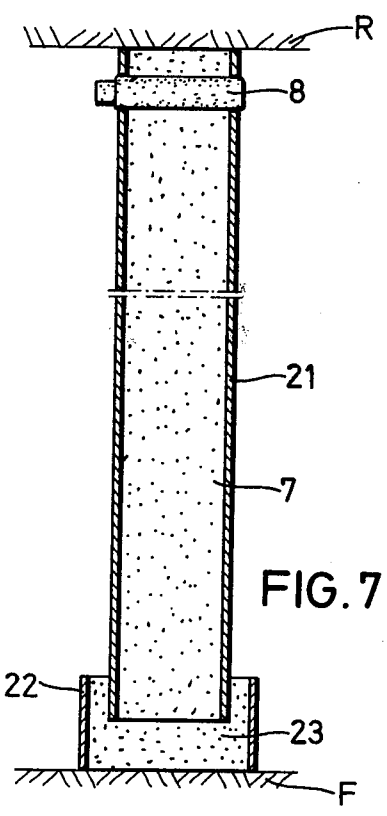
FIG. 7 is a view similar to FIG. 6, but of a further embodiment.

The embodiment in FIG. 7 is a variation of the one in FIG. 6. Here, a non-telescoping section 21 is used and has its lower end portion surrounded with spacing by a section 22 of small height. The section 22 is first filled with hardenable material in flowable state (may be the same as used for column 7). When this material has partially but not fully hardened, the section 21 is put in place and filled with the material for column 7 (one may wait until material 23 has hardened). The section 22 with its filling 23 thus in effect serves as a "foundation" which prevents escape of the flowable material from the bottom of section 21, furnishes a stable support for the section 21 and, of course, bridges relatively small differentials in the height of the section 21 and the distance from floor F to roof R.

Figure 8:
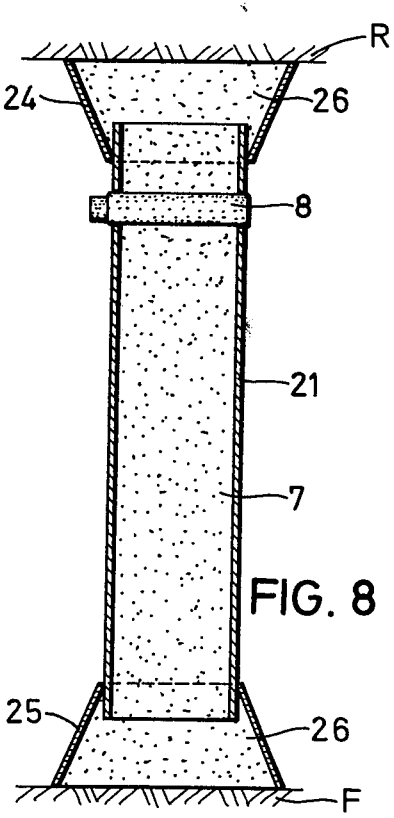
FIG. 8 is a view analogous to the one in FIG. 7 but showing a modified embodiment.

The embodiment of FIG. 8 operates on the same principle as the one in FIG. 7, except that here short extension sections 24 and 25 are used adjacent the roof and the floor; these again contain hardenable material, identified with reference numeral 6. The sections 24 and 25 are of frustoconical configuration, each having its widest part adjacent the roof or floor, respectively, so as to provide a large stress-transmitting interface between the fillings 26 (and hence the column 7) and the floor F and roof R, respectively.

Figure 9:
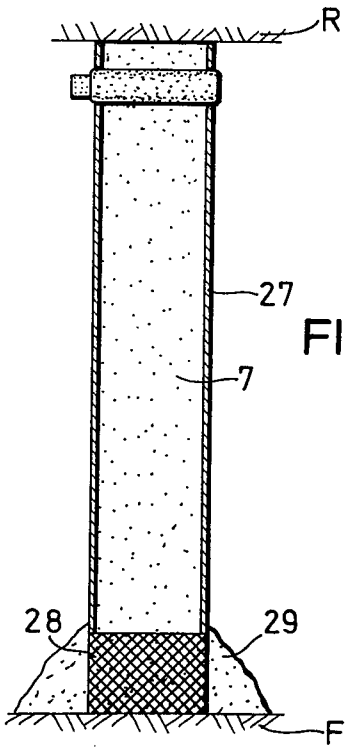
FIG. 9 is still a further axial section, showing an additional embodiment.

FIG. 9 shows an embodiment using a single, non-telescoping section 27 which it is desired to so erect that it will be pressed against the roof R with a relatively small force, but one which is adequate to maintain the section 27 in position while it is being filled and the filling hardens to form the column 7. For this purpose a wire structure 28 (e.g. an axially springily yielding ring or coil of wire) is placed between the lower end of section 27 and the floor F. To prevent the escape of flowable material from section 27 once filling of the same begins, a substance is applied around the wire structure 28 and lower end of section 27, so as to embed them and seal them to the floor F. This substance may, for example, be quick-hardening cement; once it has sufficiently hardened the introduction of flowable material into the section 27 can begin in the usual manner. The substance 29, incidentally, also increases the size of the interface via which stresses are transmitted between the column 7 and the floor F.

The same arrangement may also be provided between the roof R and the upper end of section 27, or it may be used there instead of at the lower end. Of course, the substance 29 must harden quickly enough, and have an appropriate consistency, to assure that it will not drip off the roof R when applied thereto.

Different ways of maintaining the desired degree of overlap of the marginal portions of the sheet-material sections, are shown in FIGS. 10–13. In this connection it is noted that the term "overlap" as used herein is expressly intended to refer also to the conditions shown in FIGS. 10 and 11, i.e. where the marginal portions do not actually overlie one another but instead are merely butted together.

Figure 10:
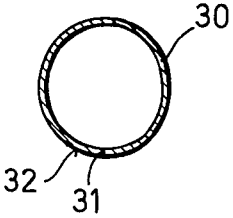

In all FIGS. 10–13 the illustrated section is designated with reference numeral 30. In FIG. 10, however, its butted-together edges are bonded together by means of a suitable known-per se adhesive 31 and/or one or more (axially spaced) straps 32 of metal or synthetic plastic material are cinched about the section 30.

Figure 11:
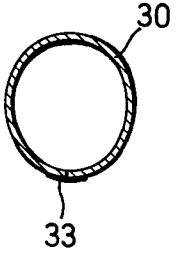

In FIG. 11 the butted-together edges of section 30 are held in place by an adhesive strip 33 of e.g. metal or synthetic plastic material which straddles them and extends longitudinally of section 30.

Figure 12:
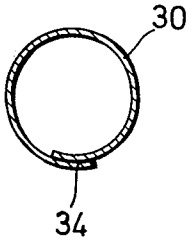
FIGS. 10–13 are all cross-sections showing, diagrammatically, how the overlapped condition of the respective casings may be fixed against change.
Figure 13:
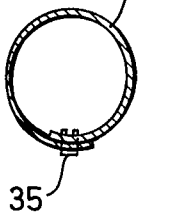

FIG. 12 shows that adhesive material 34 (known per se) may be placed between the overlapped edge portions to secure them to each other, whereas FIG. 13 shows that staples 35 (one shown) or the like may be driven through the overlapped edge portions of section 30 to hold them in position.

Of course, the possibilities shown in FIGS. 10–13 are not to be considered exhaustive; other possibilities, such as e.g. the placing of axially spaced retaining rings or the like about the sections, are also feasible.

Figure 14:
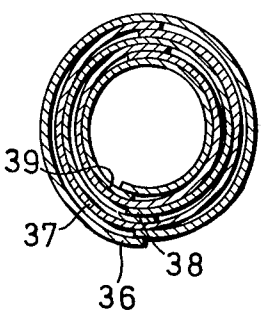
FIG. 14 is another cross-section, showing how a plurality of the inventive casings may be interleaved for storage and transport.

Finally, FIG. 14 shows the versatility of the improvement according to the invention. For storage and/or transport a large number of sections—here designated 36–39—may simply be interleaved, i.e. coiled together. It must be remembered that each section is in effect an item of sheet-material which may or may not be precurved, but which can certainly be rolled up together with other similar items. Nor is the number of such items per roll confined to four, as shown by way of example in FIG. 14.

It can readily be seen that a large number of the sections can be stored and transported in a space not much larger than that which is taken up by a single section.

This is a consideration which is particularly important in terms of the usually cramped below-ground storage and transportation facilities. Moreover, the sections are light in weight, and can therefore be erected by very small numbers of personnel and without the aid of expensive and bulky equipment. The material of the sections themselves, as well as the filling material for them, is inexpensive and this, in conjunction with the ease and small expense of their erection, promises to drastically influence tunnelling and underground mining activities, where such roof supports are needed in very large numbers.

While the invention has been illustrated and described as embodied in the supporting of mine roofs, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of supporting an overburden, particularly a roof of an underground excavation such as a mine, comprising the steps of providing a hollow tubular prop casing having at least one section of self-supporting sheet material and which is circumferentially incomplete and has a longitudinally extending slit; overlapping marginal portions of said sheet material bounding said slit, to an extent requisite for obtaining a desired diameter of said section; arresting the overlapped portions in their overlapped condition; erecting the prop casing so that it bears upon the roof to be supported; and filling the prop casing with a hardenable substance in flowable condition so that said substance, upon hardening thereof, forms a solid column which is by itself able to support the roof.

2. A method as defined in claim 1; and further comprising the step of telescoping an additional section over said one section; the step of erecting comprising placing the sections in upright position and telescoping them apart to bear against the roof and a floor of the excavation, respectively.

3. A method as defined in claim 1; and further comprising the step of imparting to said casing a prestress which biases the casing against said roof.

4. A method as defined in claim 1; and further comprising the step of increasing the interface at which said prop casing contacts said roof or a floor of the excavation, beyond the cross-sectional area of said section.

5. A method as defined in claim 1, wherein the step of filling is carried out under pressure; and further comprising the step of counteracting loss of pressure or volume in said substance subsequent to termination of the step of filling.

6. A roof supporting arrangement, particularly for supporting a roof of an underground excavation such as a mine, comprising a hollow tubular prop casing having at least one section of self-supporting sheet material and which is circumferentially incomplete and has a longitudinally extending slit bounded by marginal portions which can be overlapped to a desired degree to give said section a selectable diameter; means for arresting the marginal portions in a desired overlapped position; and means for filling the prop casing, subsequent to erection of the same so that it bears upon the roof to be supported, with a hardenable substance in flowable condition so that said substance, upon hardening thereof, forms a solid column which is by itself able to support said roof.

7. An arrangement as defined in claim 6, wherein said sheet material is metal.

8. An arrangement as defined in claim 6, wherein said sheet material is cardboard.

9. An arrangement as defined in claim 6, wherein said sheet material is a synthetic plastic.

10. An arrangement as defined in claim 6; further comprising at least one additional section telescoped over said one section, said sections being telescopable-apart to bear upon said roof and said floor, respectively.

11. An arrangement as defined in claim 10, wherein said additional section has an axial length which is substantially shorter than the axial length of said one section, and an inner diameter greater than that of said one section.

12. An arrangement as defined in claim 6; and further comprising means for biasing said one section into engagement with said roof and floor, respectively.

13. An arrangement as defined in claim 12, said biasing means comprising a resiliently yieldable bellows formed in said sheet material of said one section.

14. An arrangement as defined in claim 12, said biasing means comprising an axially springily yieldable annulus of wire mesh interposed and compressed between one end of said section and one of said roof and floor, respectively.

15. An arrangement as defined in claim 11, said additional section being of cylindrical shape.

16. An arrangement as defined in claim 11, said additional section being of frustoconical shape.

17. An arrangement as defined in claim 6; and further comprising means for counteracting losses in pressure or volume of the hardenable substance filled into said prop casing, which tend to occur subsequent to termination of the filling.

* * * * *